US009217571B1

(12) United States Patent
Frost

(10) Patent No.: US 9,217,571 B1
(45) Date of Patent: Dec. 22, 2015

(54) BURNER HEAD WITH MAGNETIC BURNER CAP CONNECTION

(71) Applicant: Timothy Frost, Chattanooga, TN (US)

(72) Inventor: Timothy Frost, Chattanooga, TN (US)

(73) Assignee: Burner Systems International, Inc., Chattanooga, TN (US)

( * ) Notice: Subject to any disclaimer, the term of this patent is extended or adjusted under 35 U.S.C. 154(b) by 310 days.

(21) Appl. No.: 13/914,721

(22) Filed: Jun. 11, 2013

Related U.S. Application Data

(60) Provisional application No. 61/658,146, filed on Jun. 11, 2012.

(51) Int. Cl.
*F24C 3/12* (2006.01)
*F24C 3/08* (2006.01)
*F23D 14/02* (2006.01)

(52) U.S. Cl.
CPC . *F24C 3/08* (2013.01); *F23D 14/02* (2013.01); *F24C 3/12* (2013.01)

(58) Field of Classification Search
CPC ..... F24C 3/08; F24C 3/12; F23D 14/02
USPC ..... 126/39 E, 9 R, 25 A, 43; 219/622, 624
See application file for complete search history.

(56) References Cited

U.S. PATENT DOCUMENTS 2,233,659 A * 3/1941 Wittmann ..... F23N 5/025 137/65
2,287,584 A * 6/1942 Weeks ..... A47J 31/047 392/445
3,540,399 A * 11/1970 Gabrielsson ..... 114/27
3,928,744 A * 12/1975 Hibino et al. ..... 219/624
4,509,659 A * 4/1985 Cloutier et al. ..... 222/41
5,303,691 A * 4/1994 Armistead ..... 126/9 R
6,058,927 A * 5/2000 Maritan ..... F24C 3/126 126/39 BA
6,802,309 B2 * 10/2004 Varnhorn ..... A47J 36/34 126/214 R

FOREIGN PATENT DOCUMENTS

DE 102007006044 A1 * 8/2008 ..... F24C 3/08

OTHER PUBLICATIONS

DE102007006044 (A1) of Mueller et al of Aug. 2008, machine translation in English.*

* cited by examiner

*Primary Examiner* — Gregory Huson
*Assistant Examiner* — Nikhil Mashruwala
(74) *Attorney, Agent, or Firm* — Stephen J. Stark

(57) ABSTRACT

A burner head and cap combination provides gas burner for use with gas appliances. At least one magnet is utilized to assist in retaining the burner cap to the burner head. Mobile appliances can particularly benefit from such a construction, such as in recreational vehicles and even stationary uses may find such a construction advantageous.

8 Claims, 1 Drawing Sheet

BURNER HEAD WITH MAGNETIC BURNER CAP CONNECTION

CLAIM OF PRIORITY

This application claims the benefit of U.S. Provisional Patent Application No. 61/658,146 filed Jun. 11, 2012 which is incorporated in its entirety by reference.

FIELD OF THE INVENTION

The present invention relates to burners for use with gas appliances, in particular, gas ranges and their construction.

BACKGROUND OF THE INVENTION

Burners for gas ranges are often constructed with a gas supply system to get gas to the burner, a burner head (which is sometimes called a flame spreader), and a burner cap. The gas supply system may be a tubular venture or a system including a tube, such as an aluminum tube, potentially along with other mechanical parts which communicate gas to the burner head.

A burner head is often brass or aluminum which is typically either machined and/or cast. Atop the burner head, a burner cap is normally provided. The burner cap is typically steel with a porcelain enamel coating. The burner cap is not normally mechanically fastened to the burner head. In many cases, the burner head rests on the top of the burner head. There can be mating geometry in the burner head and cap, and gravity alone is normally what holds a burner cap at a desired orientation relative to a burner head.

However, under some circumstances, a burner cap can become dislodged from its proper position, such as if an oven door is closed in an aggressive manner. Furthermore, these style burners are often used in recreational vehicles. As a recreational vehicle travels on the road, the burner cap can become displaced or dislodged from its desired position due to the motion of the recreational vehicle as it travels along a road.

SUMMARY OF THE INVENTION

It is an object of many embodiments of the present invention to more securely connect a burner cap to a burner head than has been done for many known prior art constructions.

It is another object of many embodiments of the present invention to provide a connection of a burner cap to a burner head without requiring bores to penetrate through a burner cap.

Accordingly, in accordance with a presently preferred embodiment of the present invention, a burner supply system provides gas to a burner head below a burner cap. The burner cap is preferably formed, at least partially of a ferromagnetic material, such as steel, and then coated with a porcelain enamel. Other caps could be constructed differently while still having a magnet, or a ferromagnetic material connected to or attractable by a magnet from, or through, a bottom surface of the burner cap.

The burner head is preferably provided with at least one, if not two or more spaced apart magnets which are provided between at least a portion of the burner head and the burner cap. These magnets can provide an magnetic attraction force to assist, along with the weight of the burner cap, to retain the burner cap in a desired position relative to the burner head, which is not normally a ferromagnetic material, but is instead, more commonly brass or aluminum. The one, or more, magnets can be attached to the burner head with screws, a swaging operation, molding them in place while casting, or other connection methods. Cutouts are envisioned as being provided in an upper surface of the burner head to receive respective magnets. Magnets may, or may not, contact the burner cap when installed in its proper installed configuration, depending upon the requirements and/or particular embodiment selected.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
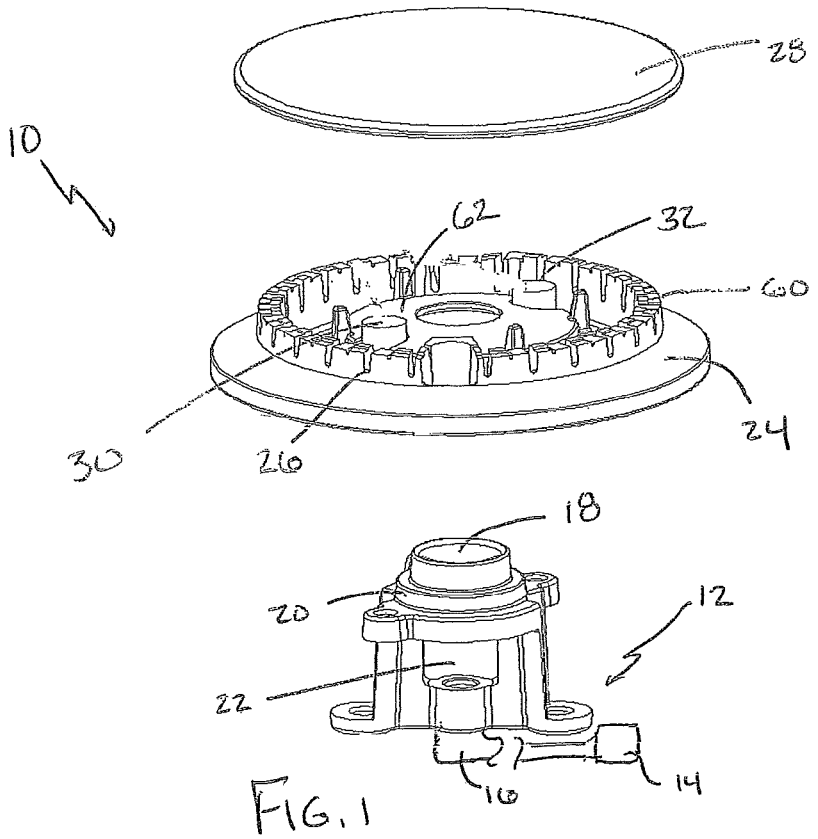
FIG. 1 is an exploded view of a proposed burner construction of a presently preferred embodiment of the present invention.

FIG. 1 shows an exploded view of a burner 10 for use with a gas appliance (not shown), such as a gas oven, range, etc. Burner 10 has a burner supply system 12 which communicates a gas source 14, such as, but not limited to natural gas as provided to a building, propane from a tank, or other source. Piping 16, illustrated as an aluminum tube, is shown directing from source 14 to a inlet 18, which may be formed as a portion of housing 20. Housing 20 may also allow for mixing with combustion air such as at gap 22. Other components as are known in the art could be positioned between the gas source 14 and inlet 18. Other burners 10 may have different gas supply systems 12 of various constructions which direct at least some gaseous fuel into the burner 10.

The gas supply system 12 directs fuel to the burner head 24. The burner head 24 is typically aluminum or brass. Other materials could be used with other embodiments. The burner head 24 is sometimes referred to as a flame spreader. It is normally cast and/or machined and provides flame slots 26 through which a lit burner 10 is normally identified. Other orifices, slots or other features may be provided along a perimeter of a burner head 24 as are known in the art which can provide for a variety of features.

On top of the burner head 24, a burner cap 28 is normally provided. The burner cap 28 is normally set on top of the burner head 24 and retained in position by gravity and, possibly a mating geometry. Burner caps 28 are normally made of steel, or other ferromagnetic material, and often coated with a porcelain enamel.

The burner cap 28 can be relatively easily removed for cleaning, but unfortunately, it can also become dislodged from its desired position under certain circumstances. For instance, if an oven door is closed in an aggressive manner, the cap 28 could become dislodged. Recreational vehicles also often have burners 10. Motion of the recreational vehicle as it travels, can dislodge the cap 10 from the burner head 24. However, the applicant has the configuration as shown and described herein which can more securely retain the burner cap 28 to the burner head 24.

Specifically, at least one, if not a plurality, such as two, or more, magnets 30,32 are positioned between at least a portion of each of the burner cap 28 and burner head 24. Magnets 30,32 may be retained to the burner head 24 in a variety of manners as known in the art. A number of examples are shown in FIGS. 2A and 2B.

Figure 2A:
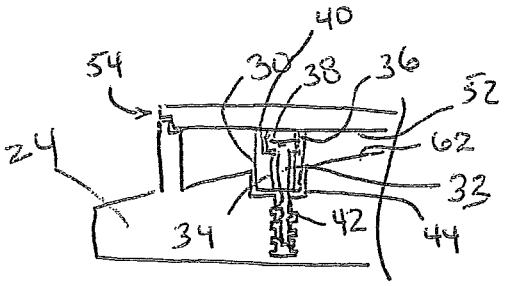
FIGS. 2A and 2B are cross sectional views taken along the line A-A in FIG. 1 showing two different preferred construction alternatives.

FIG. 2A shows a screw 33 passing through a bore 34 in the magnet 30. A cutout 36 provides a location for the screw head 38 to be recessed relative to an upper surface 40 of the magnet 30. Screw threads 42 are shown engaging internally to a portion of the burner head 24 to securely connect the magnet 30 to the burner head 24, which is normally aluminum or brass (i.e., non-ferromagnetic). A depression 44 may be molded into, or otherwise provided to recess at least a portion of the magnet 30 into the burner head 24 for at least some embodiments.

Figure 2B:
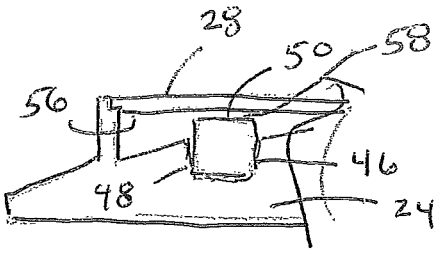

FIG. 2B shows magnet 32 swaged into the burner head 24. Swaging can occur when a cross section 46 of the magnet 42 is larger enough to friction fit within a cross section 48 of the depression 44, at least at some point. Alternatively, the magnet 32 could be cast in place during the casting process, adhered to the burner head 24, or otherwise connected to the burner head 24.

FIG. 2A shows a first embodiment with the upper surface 40 of the magnet 30 contacting a lower surface 52 of the burner cap 28. This provides additional holding forces over and above gravity, or weight of the burner cap 28 and possibly mating geometries, like the lip and shoulder construction illustrated at cap edge 54.

However, as shown in FIG. 2B, the magnet 32 with its upper surface 52 need not contact lower surface 56 of burner cap 28 in all embodiments. A gap 58 could separate the burner cap 28 from the magnet 32, while still being close enough to communicate magnetic attraction forces to assist in retaining the magnetic cap 28 to the burner head 24.

Furthermore, although the preferred constructions include providing the magnet(s) 30,32 connected to the burner head 24, other embodiments could connect magnet(s) 30 and/or 32 to the burner cap 28 and providing a ferromagnetic material and/or cooperating magnet connected to the burner head 24.

As shown in the figures, magnet(s) 30 or 32 can preferably be located internal to a flame perimeter 60 of the burner head 24, although in some embodiments, the magnet(s) could be located radially external to the flame perimeter 60. In fact, they can be located along and/or into a flame spreader 62 as illustrated in the figures, for at least some embodiments. Other embodiments may locate one or more of the magnet(s) 30,32 differently. Furthermore, when using more than one magnet 30,32, they may be symmetrically disposed, as illustrated, for at least some embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A burner for use with gas appliances comprising;
   a burner supply system communicating a gas supply through a burner head capped with a burner cap comprising a ferromagnetic material within the cap wherein the burner head is a non-ferromagnetic material; and
   at least one magnet connected to a burner head to be disposed between at least a portion of the cap and the burner head, wherein the at least one magnet provides a magnetic attraction force to assist in retaining the cap relative to the burner head.

2. The gas burner of claim 1 wherein the at least one magnet has a bore proceeding therethrough and a screw extends through the bore thereby securely connecting the at least one magnet to the burner head.

3. The gas burner of claim 1 wherein the at least one magnet is connected to the burner head.

4. The gas burner of claim 3 wherein the at least one magnet contacts the burner cap when the burner cap is installed.

5. The gas burner of claim 1 wherein the at least one magnet is located internal to a flame perimeter of the burner head.

6. The gas burner of claim 1 further comprising a flame spreader in the burner head and wherein the at least one magnet is located along the flame spreader.

7. The gas burner of claim 6 wherein the at least one magnet is disposed at least partially in the flame spreader.

8. The gas burner of claim 1 having at least two magnets symmetrically disposed relative to the burner cap.

* * * * *